US009295607B2

(12) United States Patent
Rosenberg

(10) Patent No.: US 9,295,607 B2
(45) Date of Patent: Mar. 29, 2016

(54) METHOD AND APPARATUS FOR NON-INVASIVE AESTHETIC TREATMENT OF SKIN AND SUB-DERMIS

(75) Inventor: Avner Rosenberg, Bet Shearim (IL)

(73) Assignee: Syneron Medical LTD, Yoqneam Illit (IL)

( * ) Notice: Subject to any disclaimer, the term of this patent is extended or adjusted under 35 U.S.C. 154(b) by 539 days.

(21) Appl. No.: 13/389,799

(22) PCT Filed: Aug. 15, 2010

(86) PCT No.: PCT/IL2010/000656

§ 371 (c)(1), (2), (4) Date: Feb. 9, 2012

(87) PCT Pub. No.: WO2011/021184

PCT Pub. Date: Feb. 24, 2011

(65) Prior Publication Data

US 2012/0150079 A1 Jun. 14, 2012

Related U.S. Application Data

(60) Provisional application No. 61/235,366, filed on Aug. 20, 2009.

(51) Int. Cl.

| | |
|---|---|
| ***A61H 7/00*** | (2006.01) |
| ***A61H 9/00*** | (2006.01) |
| *A61H 23/02* | (2006.01) |

(52) U.S. Cl.

CPC ..... *A61H 7/003* (2013.01); *A61H 7/008* (2013.01); *A61H 9/0057* (2013.01); *A61H 23/0236* (2013.01); *A61H 2201/10* (2013.01); *A61H 2201/5035* (2013.01); *A61H 2207/00* (2013.01)

(58) Field of Classification Search

CPC .... A61H 7/00–7/05; A61H 7/08; A61H 9/05; A61H 9/057; A61H 9/071; A61H 2201/10; A61H 2201/0157; A61H 2201/1238; A61H 2201/5056; A61H 2009/00; A61H 2009/005; A61H 2209/0064; A61H 2023/00; A61H 2023/04; A61H 2207/00; A61H 7/003; A61H 7/005; A61H 7/008; A61H 9/00; A61H 9/005; A61H 9/0057; A61H 2201/5035

USPC ..... 601/6, 9–10, 12–14, 15

See application file for complete search history.

(56) References Cited

U.S. PATENT DOCUMENTS

| | | | | |
|---|---|---|---|---|
| 2,088,780 | A | 8/1937 | Follese | |
| 4,428,368 | A * | 1/1984 | Torii | 601/9 |
| 5,601,526 | A | 2/1997 | Chapelon et al. | |
| 5,897,512 | A * | 4/1999 | Zagame | 601/6 |
| 6,200,281 | B1 * | 3/2001 | Frajdenrajch | 601/84 |
| 6,328,704 | B1 * | 12/2001 | Hagiwara | 601/6 |
| 6,443,915 | B1 | 9/2002 | Hwang | |

(Continued)

FOREIGN PATENT DOCUMENTS

| | | | | |
|---|---|---|---|---|
| GB | 2261603 | * 11/1991 | | A61H 7/00 |

*Primary Examiner* — Quang D Thanh

(74) *Attorney, Agent, or Firm* — Smith Tempel; Gregory Scott Smith

(57) ABSTRACT

A method for treatment of skin and sub-dermis by a housing. The housing accommodates two adjacent vacuum chambers sharing at least one common wall between them. The chambers a coupled to a surface of skin and the air pressure in the chambers is alternated such as to effect back and forth massaging movement of skin tissue in parallel to the surface of said skin.

8 Claims, 8 Drawing Sheets

(56) References Cited

U.S. PATENT DOCUMENTS

| | | | | |
|---|---|---|---|---|
| 6,539,946 | B2 * | 4/2003 | Weyergans | 128/898 |
| 8,133,191 | B2 | 3/2012 | Rosenberg et al. | |
| 8,273,037 | B2 | 9/2012 | Kreindel et al. | |
| 2003/0032900 | A1 | 2/2003 | Ella | |
| 2004/0260210 | A1 | 12/2004 | Ella et al. | |
| 2006/0058712 | A1 | 3/2006 | Altshuler et al. | |
| 2006/0211958 | A1 * | 9/2006 | Rosenberg et al. | 601/9 |
| 2007/0239077 | A1 | 10/2007 | Azhari et al. | |
| 2008/0051680 | A1 | 2/2008 | Luebcke | |
| 2008/0139974 | A1 | 6/2008 | Da Silva | |
| 2008/0146970 | A1 | 6/2008 | Litman et al. | |
| 2008/0167585 | A1 * | 7/2008 | Khen et al. | 601/6 |
| 2009/0275865 | A1 | 11/2009 | Zhao et al. | |
| 2009/0306647 | A1 * | 12/2009 | Leyh et al. | 606/34 |
| 2011/0015549 | A1 | 1/2011 | Eckhouse et al. | |
| 2012/0116271 | A1 | 5/2012 | Caruso et al. | |
| 2013/0178764 | A1 * | 7/2013 | Eckhouse et al. | 601/2 |

* cited by examiner

METHOD AND APPARATUS FOR NON-INVASIVE AESTHETIC TREATMENT OF SKIN AND SUB-DERMIS

CROSS-REFERENCE TO RELATED APPLICATIONS

This application is being filed under 35 U.S.C. 371 and claims the benefit of the filing date of United States provisional application for patent that was filed on Aug. 20, 2009 and assigned Ser. No. 61/235,366 by being a national stage filing of International Application Number PCT/IL2010/000656 filed on Aug. 15, 2010, each of which are incorporated herein by reference in their entirety.

TECHNICAL FIELD

The method and apparatus relate to the field of aesthetic body shaping devices and more specifically to methods and apparatuses for aesthetic massage treatment of human skin and sub-dermis.

BACKGROUND

Cellulite affects around 85-90% of post-pubertal females and some men of all races and is characterized by a dimpled appearance of the skin. It occurs mainly around the arms, hips, thighs, and buttocks.

Collagen fibrous walls in the sub-dermal fat layer, named septae, connect the sub-dermal fat tissue to the skin. Cellulite occurs when sub-dermal fat cells are pushed upwards, and the septae pushed downwards pulling the attached skin with them. As a result, the septae urge the fat cells deposited therebetween into small bulges protruding from the surface of the skin and resulting in a characteristic dimpled, pitted appearance of the skin surface.

Numerous therapies are used in the treatment of cellulite which include physical and mechanical methods as well as the use of pharmacological agents. The physical and mechanical methods include iontophoresis, light, ultrasound, thermotherapy, pressotherapy (pneumatic massaging in the direction of the circulation), lymphatic drainage (massage technique to stimulate lymphatic flow), electrolipophoresis (application of a low frequency electric current) and high frequency electrical current such as RF.

Aesthetic treatments of cellulite combining the application of sub-atmospheric pressure (a vacuum) to a segment of skin, urging it into a chamber and skin massage, with or without the application of heat energy, are documented in the art.

Almost all massage elements described in the art are based on mechanical displacement of a moving part, such as a roller or a pivoting divider. In most cases this mechanical action is driven by an actuator such as a motor. In few cases vacuum is used for manipulation of a mechanical element.

The use of moving mechanical elements and actuators in such applicators increases their complexity, required maintenance and cost. Moving mechanical elements may also interfere with the various types of heating energy delivery surfaces typically employed by such applicators.

Attempts have been made in the art to simplify applicators by replacing the mechanical elements with a deformable membrane, the inside surface thereof sealing a vacuum chamber and the outside surface adhering to the skin. Creation of sub-atmospheric pressure inside the chamber creates a suction effect on the membrane and skin, drawing both into the chamber.

Furthermore, MR imaging 3D reconstruction of the collagen fibrous septae network in the skin tissue demonstrates a high percentage of septae oriented in a direction perpendicular to the skin surface in women with cellulite. The massage elements described in the art cause the skin tissue to move in and out of a single vacuum chamber, resulting in displacement of the skin tissue in a direction vertical to the skin surface and in parallel to the fibrous septae orientation. Additionally, methods in the art couple heating energy treatment to the skin massage treatment. The applied energy source (For example, ultrasound) employed by these methods is typically positioned over skin areas that are not adhered to a vacuum chamber or a deformable membrane and therefore are not being concurrently massaged. Application of energy to non-massaged skin areas negates the synergistic effect produced by the concurrent combination of skin massage and energy application.

The combination of heat and concurrent back and forth massaging movement of skin break down the fibrous septae network thus eliminating the pitted appearance of the skin surface. The combination of heat and vacuum also enhances circulation in the treated area and increases metabolic action, which reduces the amount of sub-dermal fat further contributing to the elimination of the pitted appearance of the skin surface. Therefore, there is a need for improved cellulite treatments that would include massaging movement of skin, with or without the application of heating energy, would bring improved treatment results and better elimination of the undesired effects of cellulite.

SUMMARY

The present method and apparatus effect vacuum and massage to human skin tissue for reduction of effects of cellulite. The method and apparatus are based on coupling an applicator accommodating one or more vacuum chambers sharing one or more common walls therebetween to the surface of the skin and alternately reducing the air pressure in the vacuum chambers to affect vacuum suction to the skin, alternately drawing adjacent segments of skin into the vacuum chambers.

The alternating suction effect generates enhanced massaging back and forth movement of the skin tissue against the common wall between adjacent vacuum chambers, parallel to the skin surface and perpendicular to the collagen fibrous septae orientation. This action is achieved using vacuum chambers alone without the use of mechanical actuators and/or any moving parts.

The method and apparatus also couple heating energy to the application of vacuum and massage. Such heating energy may be in different forms selected from a group of light, RF, ultrasound, electrolipophoresis, iontophoresisand and microwaves and delivered by heating energy delivery surfaces. The heating energy delivery surfaces may be located in one or more locations including inside the vacuum chambers, between the vacuum chambers or any combination thereof.

According to an exemplary embodiment of the method and apparatus, the vacuum chamber walls, or segments thereof, are made of conductive material and are operative to deliver RF heating energy. Alternatively, only the common wall between adjacent vacuum chambers may be made of an electrically conductive material and function, as a whole, as an RF electrode.

According to another exemplary embodiment of the method and apparatus one or more RF electrodes are located on the inner face of one or more walls of adjacent vacuum chambers. Additional one or more RF electrodes are located on either or both faces of the common wall therebetween.

Alternatively and additionally, the RF electrodes may extend beyond the inner face of the vacuum chamber walls to apply heating energy to adjacent skin tissue about to be drawn into the vacuum chambers.

RF energy delivery may be controlled by a machine controller in only one vacuum chamber or more than one vacuum chambers, concurrently, in an alternating fashion or in any other sequence according to a predetermined treatment protocol.

According to yet another exemplary embodiment of the method and apparatus the machine control is operative to control the alternating sequence of vacuum application in adjacent vacuum chambers as well as the type of air pressure so that to effect an asymmetric massaging movement of the skin tissue in parallel to the surface of said skin so as to displace the applicator along the surface of the skin.

Exemplary embodiments of the method and apparatus may also be employed in other aesthetic skin tissue treatments such as sub-dermal fat cells breakdown lessening the amount of sub-dermal fat, tightening loose skin, tightening and firming body surface, reducing wrinkles in the skin and collagen remodeling.

GLOSSARY

The terms "Skin tissue" and "Skin" are used interchangeably in the present disclosure and mean the superficial layer of skin including the epidermis and dermis and all dermal structures such as sensory nerve endings, blood vessels, sweat glands, etc.

The term "Sub-Dermis" as used in the present disclosure means the skin layer below the dermis including tissues such as fat and collagen fibrous septae.

The terms "Vacuum", "Suction" and "Sub-atmospheric air pressure" are used interchangeably in the present disclosure and mean any air pressure less or lower than ambient air pressure.

BRIEF DESCRIPTION OF THE DRAWINGS

The present method and apparatus will be understood and appreciated from the following detailed description, taken in conjunction with the drawings in which.

DETAILED DESCRIPTION OF EXEMPLARY EMBODIMENTS

Figure 1:
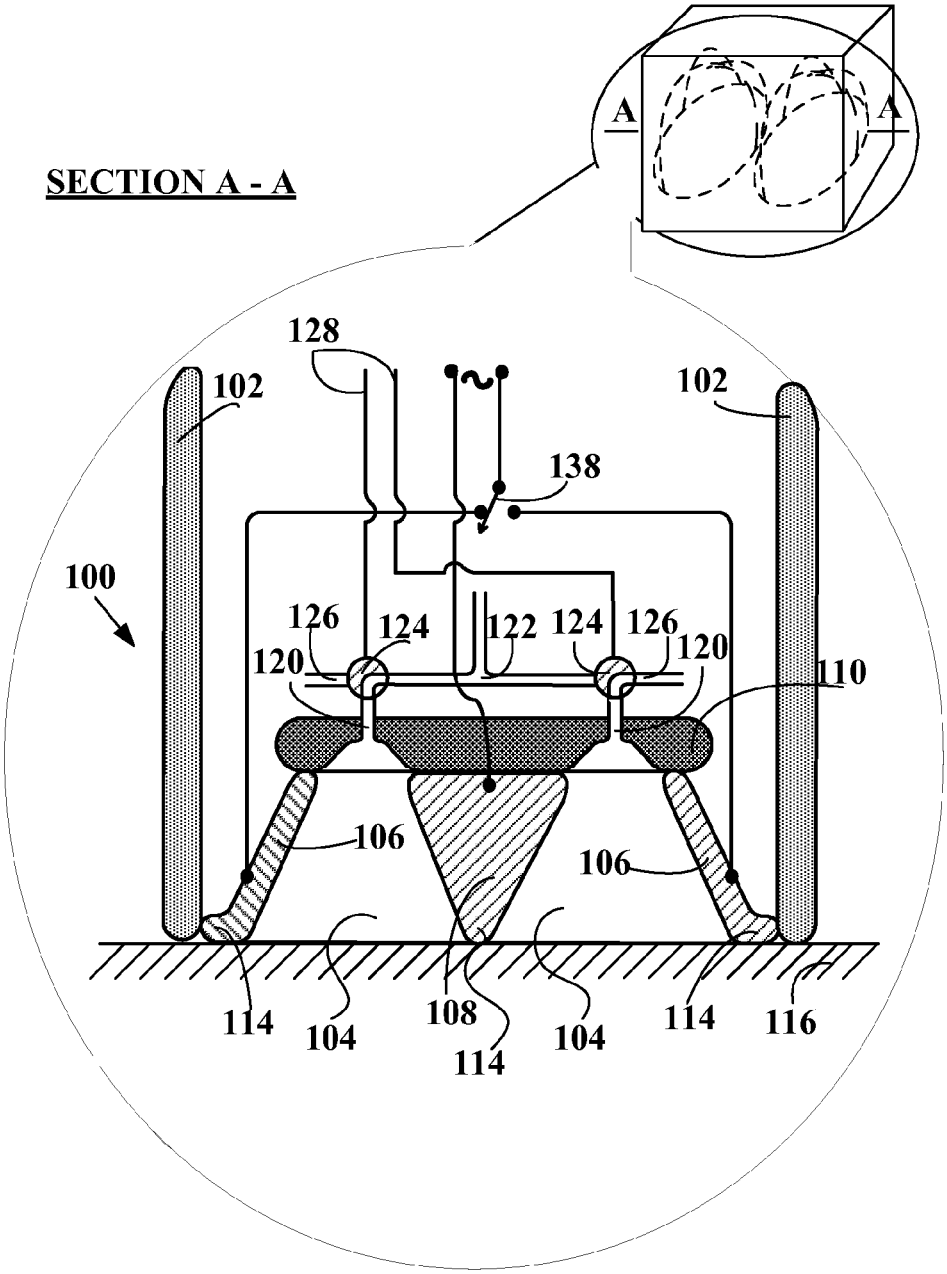
FIG. 1 is a simplified cross-sectional view of an applicator for treatment of human skin and sub-dermis in accordance with an exemplary embodiment of the present method and apparatus.

Reference is now made to FIG. 1, which illustrates a cross-sectional view of an applicator 100 having a housing 102 accommodating one or more vacuum chambers. FIG. 1, for example, illustrates two vacuum chambers 104. Chambers 104 are defined by the inner surfaces of walls 106 and 108, closed portion 110 and the surface of skin tissue 116. Sealing edges 114 of walls 106 may be flared to increase contact area with the surface of skin tissue 116 and provide a better seal therewith. Additionally, sealing edge 114 of wall 108 may be coated with a high friction coating to enhance massaging of skin tissue 116 being urged there against. For example, the vacuum chamber may be of the type disclosed in assignee's U.S. patent application Ser. No. 12/503,834 the disclosures of which is hereby incorporated by reference.

One or more sources of one or more air pressure types selected from a group consisting of sub-atmospheric air pressure, positive air pressure and ambient air pressure communicate with chambers 104. For example, in the exemplary embodiment shown in FIG. 1, sub-atmospheric air pressure is applied to chambers 104 through a conduit 122 and a bore 120 in closed portion 110 thus creating a vacuum within chambers 104. Chambers 104 are also vented to the surrounding ambient air through conduit 126. Alternatively positive air pressure may be delivered through conduit 126 or through another conduit (not shown).

The desired source of air pressure in chambers 104 is selected by employing a valve 124, which may be any standard single-way or multiple way valve as known in the art.

Vacuum values within vacuum chambers 104 may be within the range of 0.05 Bar to 1 Bar below ambient pressure. Typically, the vacuum values are within the range of 0.1 Bar to 0.5 Bar below ambient pressure.

A machine controller (not shown) connected to each selector valve 124 by electrical conductors 128 selects the desired type of air pressure and sequence of application thereof, for each vacuum chamber 104 individually, from a multiplicity of predetermined treatment program protocols. For example, alternating the application of sub-atmospheric pressure in each of two adjacent vacuum chambers 104 creates alternating suction forces on adjacent areas of treated skin tissue 116, urging skin tissue 116 to move in and out of the corresponding vacuum chambers 104. Suction of skin tissue 116 into a vacuum chamber 104 creates a skin protrusion (as illustrated in FIGS. 3 and 4) drawing adjacent skin tissue into the chamber. Concurrent relief of suction in an adjacent chamber 104 releases the tension on the protrusion within the chamber allowing skin tissue 116 to relax, exit the chamber and be drawn into the adjacent chamber 104 in which suction is concurrently being applied. This creates additional and concurrent back and forth movement of skin tissue 116, between adjacent chambers 104, parallel to the surface of skin tissue 116, against the sealing edge 114 of wall 108. This parallel skin and tissue movement creates a massaging effect, perpendicular to the collagen fibrous septae in the sub-dermis (not shown) resulting in breaking down of the septae. Actuation of the skin tissue parallel to the surface thereof and perpendicular to the collagen fibrous septae orientation has been shown to be more effective in breaking down the fibrous septae and reducing the ill-effects of cellulite and will be described below in detail.

According to an exemplary embodiment of the method and apparatus heating energy may be coupled to skin tissue 116 concurrently with the application of vacuum and massage. Such heating energy may be in different heating energy forms selected from a group consisting of light, RF, ultrasound, electrolipophoresis, iontophoresis and microwaves. Different forms of energy may be concurrently applied in each chamber.

According to an exemplary embodiment of the method and apparatus, RF energy is employed so that energy is delivered into skin tissue to heat the skin and sub-dermal tissues inside, and adjacent to, the vacuum chambers that are concurrently being massaged. This produces a synergistic effect and enhances the breakdown of the dermal collagen fibrous septae.

The sequence and duration of RF energy emission by the RF electrodes in vacuum chambers 104 is synchronized with the sequence and duration of application of the selected type of air pressure in vacuum chambers 104 by the machine controller (not shown) connected to switch 138 (connection not shown).

Commonly RF frequency is in the range from 50 KHz to 200 MHz. Typically, RF frequency is from 100 KHz to 10 MHz or from 100 KHZ to 100 MHz or, alternatively, from 300 KHz to 3 MHz.

Commonly, RF power is in the range from 0.5 W to 300 W. Typically, the range of the RF power is from 1 W to 200 W or from 10 W to 100 W.

Commonly, the range of ultrasound energy frequency is from 100 kHz to 10 MHz. Typically, the range of ultrasound energy frequency is from 500 kHz to 5 MHz. Typically, the range of power density is 0.1 W/cm2 up to 5 W/cm2.

Reference is now made to FIGS. 2A, 2B, 2C, and 2D, which are simplified illustrations of various alternative configurations of the energy delivery surfaces of the apparatus of FIG. 1.

Figure 2A:
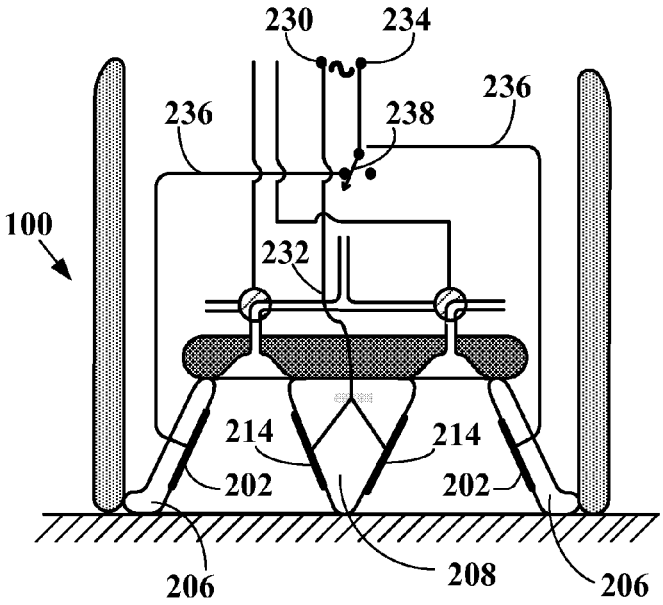
FIGS. 2A, 2B, 2C & 2D, collectively referred to as FIG. 2, are simplified illustrations of various alternative configurations of the energy delivery surfaces of the apparatus of FIG. 1.

In the embodiment of FIG. 2A, heating energy delivery surfaces 202 are located on the inner face of walls 206 of adjacent vacuum chambers and energy delivery surfaces 214 are located on both faces of the common wall 208 therebetween.

Figure 2B:
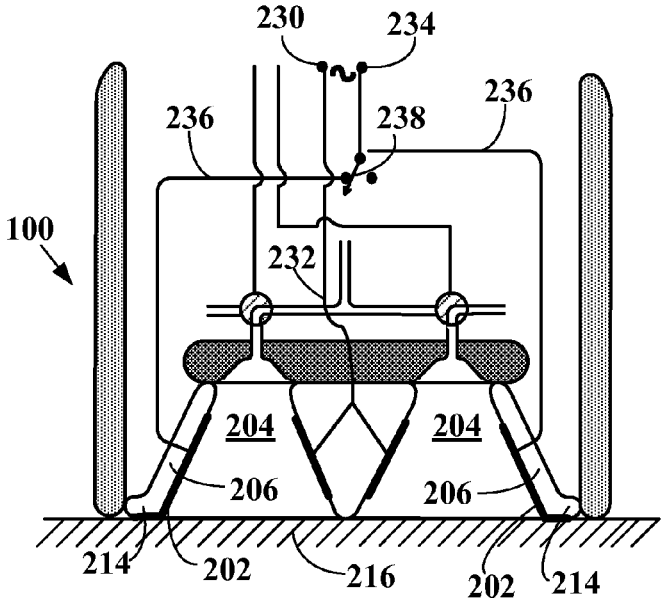

In the embodiment of FIG. 2B, heating energy delivery surfaces 202 extend beyond the inner face of the vacuum chamber walls 206, of which sealing edges 214 are flared outwardly to provide extended heating energy delivery surfaces and apply heating energy not only to tissues within vacuum chambers 204, but to adjacent skin tissue 216 as well about to be drawn into the vacuum chambers.

Figure 2C:
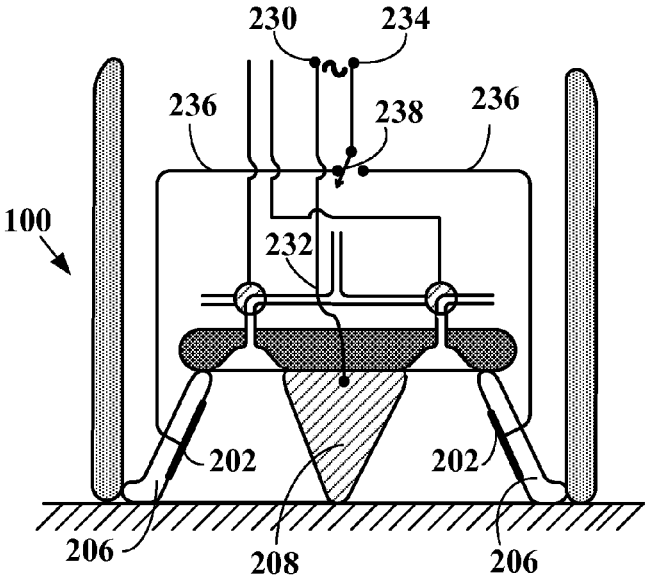

In the embodiment of FIG. 2C, heating energy delivery surfaces 202 are located on the inner face of walls 206, which are made of an electrically insulating material. Wall 208 is made of a conductive material, as indicated in FIG. 2C by a diagonal-lines-fill, and serves, as a whole, as an RF electrode.

Figure 2D:
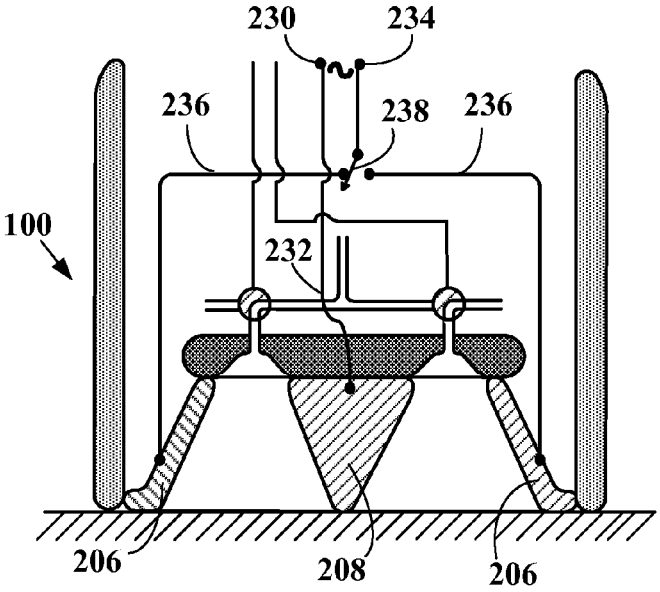

In the embodiment of FIG. 2D, Walls 206 and 208 are electrically conductive, in which case walls 206 and 208, as a whole, serve as RF electrodes. The walls bordering walls 206 and 208 (not shown) are made of an electrically insulating material. Alternatively, segments of walls 206 and 208 may be electrically conductive while others may be electrically insulated.

In any one of the above configurations, wall 208, or energy delivery surface 202 thereon, is electrically connected to pole 230 of an RF energy source through conductor 232. A pole 234 of the RF energy source is electrically connected to one or more walls 206, or energy delivery surfaces 202 thereon, through conductors 236. RF energy delivery from the RF energy source to walls 206 and 208, or energy delivery surface 202 thereon, is controlled by switch 238.

It will be appreciated that apparatus 100 may employ any one or combination of the above configurations.

Reference is now made to FIGS. 3A, 3B, 3C & 3D, which illustrate stages of the operation of applicator 100 of FIG. 1 in massaging the skin tissue 316 and sub-dermis 320, including collagen fibrous septae, which are generally perpendicular to the surface of skin 316, in accordance with an exemplary embodiment of the method and apparatus.

Figure 3A:
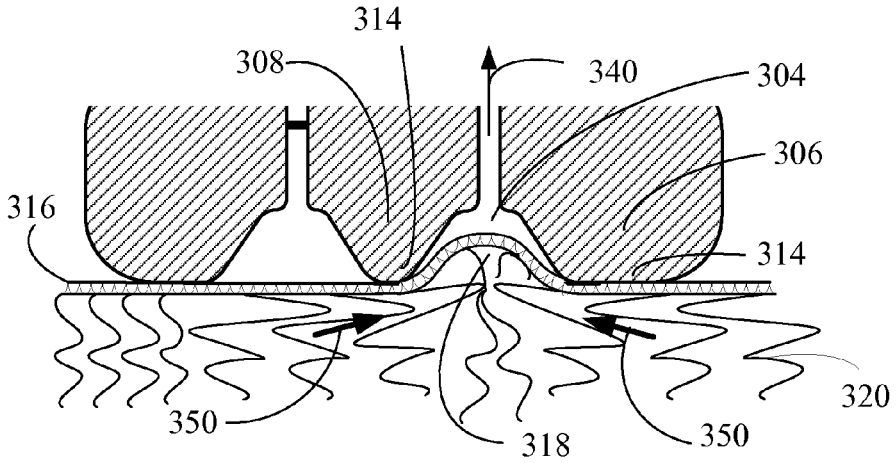
FIGS. 3A, 3B, 3C & 3D, collectively referred to as FIG. 3, are simplified illustration of the operation of the applicator of FIG. 1 in massaging the skin tissue in accordance with another exemplary embodiment of the method and apparatus.

In FIG. 3A, sub-atmospheric pressure is applied in vacuum chamber 304, as indicated by arrow 340, drawing skin tissue 316 and sub-dermis 320 into chamber 304 creating skin protrusion 318. The suction of skin tissue 316 and sub-dermis 320 into vacuum chamber 304 draws adjacent skin tissue to converge, parallel to the surface of skin tissue 316, towards and into vacuum chamber 304 as depicted by arrows designated by reference numeral 350. This movement urges skin tissue 316 and sub-dermis 320 against sealing edges 314 of walls 306 and 308 massaging skin tissue 316 and breaking down collagen fiber septae in sub-dermis 320, which are perpendicular in orientation to the direction of movement of skin tissue 316.

Figure 3B:
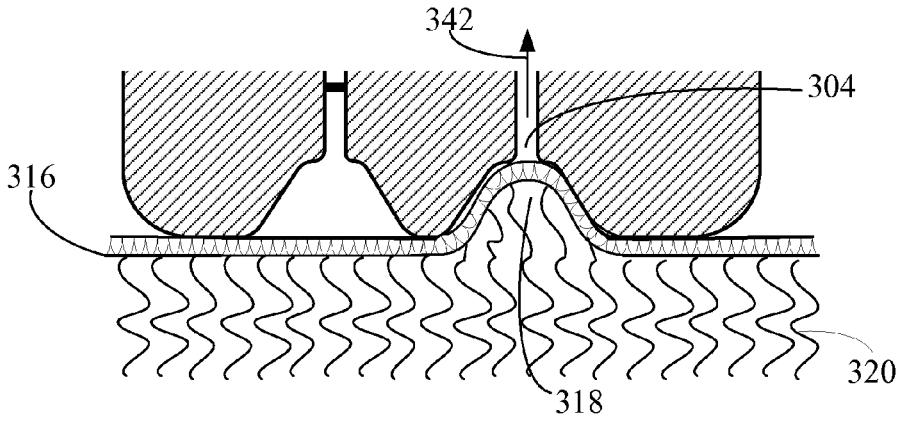

In FIG. 3B, protrusion 318 fills vacuum chamber 304, suction is maintained by sub-atmospheric pressure in chamber 304, as indicated by arrow 342, holding in place protrusion 318.

Figure 3C:
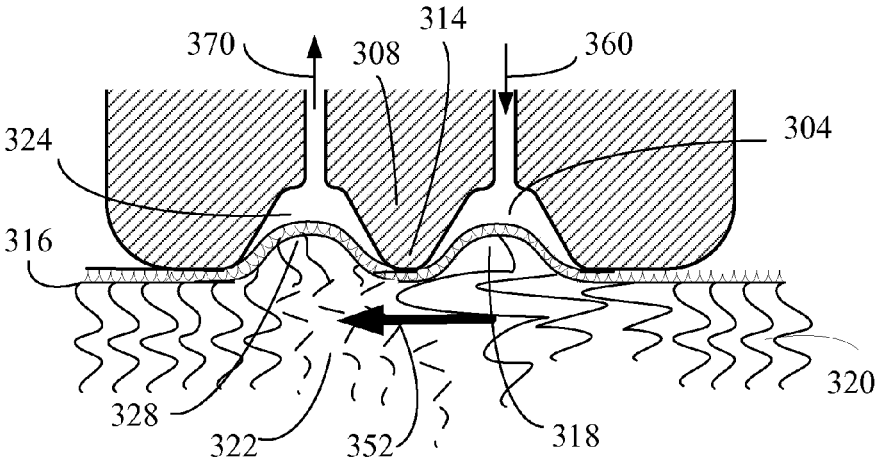

In FIG. 3C, chamber 304 is vented, increasing the pressure inside the chamber to ambient atmospheric pressure and releasing the suction holding in place protrusion 318 inside chamber 304. Concurrently, sub-atmospheric pressure is applied in vacuum chamber 324, as indicated by arrow 370, sucking skin tissue 316 into chamber 324 creating protrusion 328. Concurrent relief of suction in adjacent chamber 304 releases the tension on the protrusion within the chamber allowing skin tissue 316 to relax, exit the chamber, travel in parallel to the surface of skin 316, as depicted by the arrow here designated by reference numeral 352, and be drawn into the adjacent chamber 324 in which suction is concurrently being applied. This creates additional and concurrent back and forth movement of skin tissue 316, between adjacent chambers 304 and 324, parallel to the surface of skin tissue 316, against the sealing edge 314 of wall 308. This movement, perpendicular to the orientation of the collagen fibrous septae, strongly urges skin tissue 316 and sub-dermis 320 against sealing edge 314 of wall 308, further massaging the tissue, applying enhanced shearing forces to the collagen fibrous septae in the sub-dermis 320, breaking down the septae as indicated by reference numeral 322. Alternatively, positive air pressure may be pumped into chamber 304, as indicated by arrow 360, forcing protrusion 318 out of vacuum chamber 304, strongly urging skin tissue 316 against sealing edge 314 of wall 308 and further enhancing the shearing forces on the collagen fibrous septae in the sub-dermis 320.

Figure 3D:
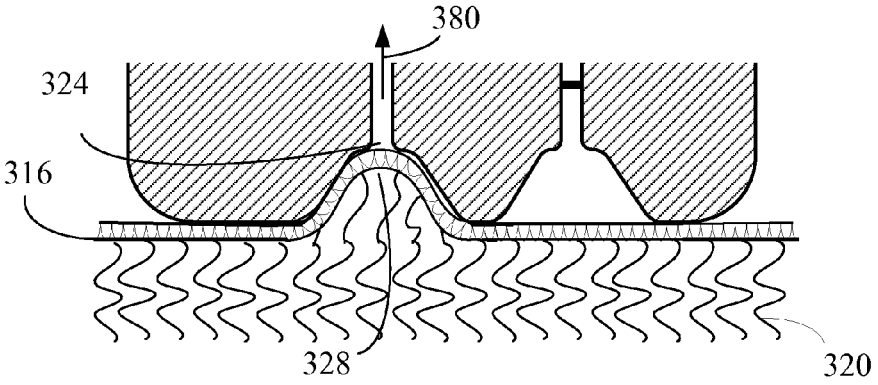

In FIG. 3D, protrusion 328 fills vacuum chamber 324, sub-atmospheric pressure is maintained in chambers 324, as indicated by arrow 380, holding in place protrusion 328 and all movement of skin tissue is stopped.

It is appreciated that this cycle may be repeated or reversed, with or without concurrent energy treatment application, in accordance with a predetermined treatment program protocol to effect enhanced back and forth symmetrical massaging movement of the skin tissue 316 against sealing edge 314 of common wall 308 in parallel to the surface skin tissue 316, further breaking down the collagen fibrous septae in the sub-dermis.

Reference is now made to FIGS. 4A, 4B, 4C, 4D, 4E & 4F, which illustrate the sequence of the application of air pressure to adjacent vacuum chambers effecting asymmetrical skin movement and displacement of the applicator 100 of FIG. 1 along the surface of the skin 416 in accordance with an exemplary embodiment of the method and apparatus.

Figure 4A:
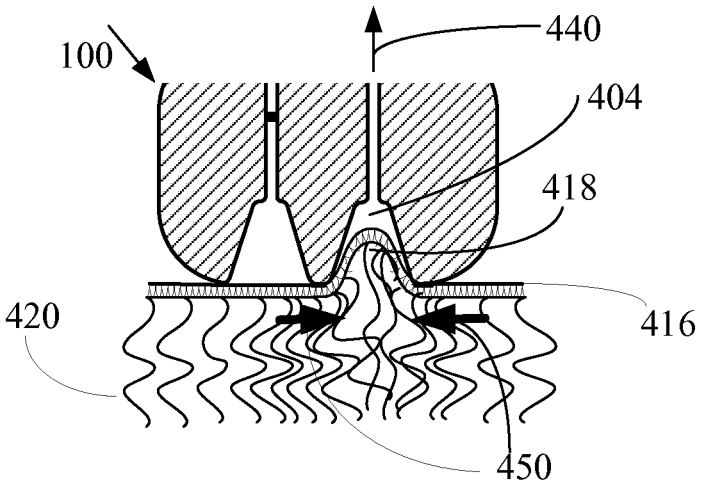
FIGS. 4A, 4B, 4C, 4D, 4E and 4F, collectively referred to as FIG. 4, are simplified illustration of the operation of the applicator of FIG. 1 effecting the displacement thereof in accordance with yet another exemplary embodiment of the method and apparatus.

In FIG. 4A, sub-atmospheric pressure is applied in vacuum chamber 404, as indicated by arrow 440, sucking skin tissue 416 into chamber 404 and creating protrusion 418. Suction of skin tissue 416 into vacuum chamber 404 draws adjacent skin tissue to symmetrically converge, parallel to the surface of skin tissue 416, towards vacuum chamber 404 as depicted by arrows designated by reference numeral 450. At this stage, there is no directional displacement of applicator 100.

Figure 4B:
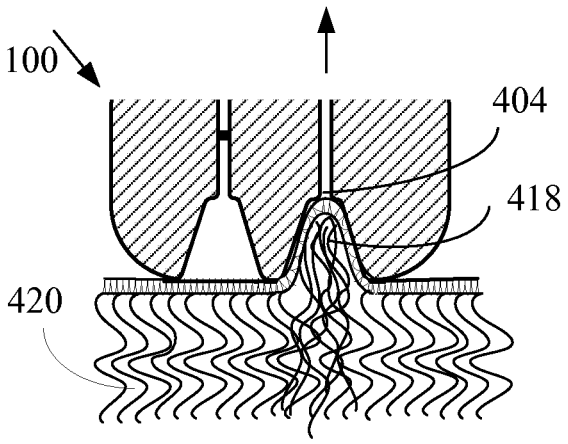

In FIG. 4B, skin tissue protrusion 418 fills vacuum chamber 404 and suction in chamber 404 is maintained.

Figure 4C:
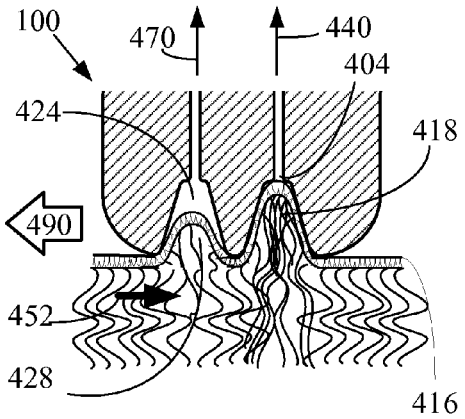

In FIG. 4C, sub-atmospheric pressure continues to be maintained in chamber 404, as indicated by arrow 440, holding in place protrusion 418. Concurrently, sub-atmospheric pressure is applied in vacuum chamber 424, as indicated by arrow 470, sucking skin tissue 416 into chamber 424 and creating protrusion 428. The movement of skin tissue 416 into vacuum chamber 424 asymmetrically draws adjacent skin tissue to travel parallel to the surface of skin tissue 416, towards vacuum chamber 424 as depicted by the arrow here designated by reference numeral 452. This asymmetrical movement of skin tissue 416 also pulls skin protrusion 418, strongly adhered to chamber 404, in a direction opposite to that indicated by arrow 452, effecting directional displacement of applicator 100 in a direction indicated by arrow designated by reference numeral 490.

Figure 4E:
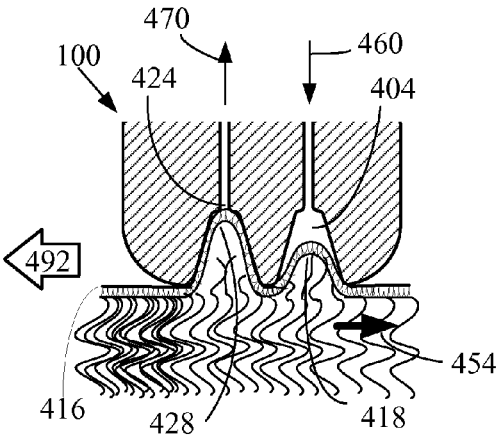
Figure 4D:
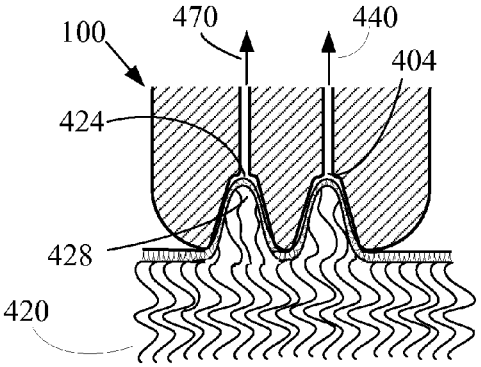

In FIG. 4D, sub-atmospheric pressure is maintained in both chambers 404 and 424, holding in place protrusions 418 and 428 respectively. At this stage, there is no displacement of applicator 100.

In FIG. 4E, sub-atmospheric pressure is maintained in chamber 424, holding skin protrusion 428 in place. Concurrently, chamber 404 is vented, increasing the pressure inside the chamber to surrounding ambient air pressure and releasing the vacuum holding protrusion 418 inside chamber 404 in place. Alternatively, positive air pressure is pumped into chamber 404, as indicated by arrow 460, urging skin protrusion 418 out of vacuum chamber 404. This releases the pulling tension on the skin tissue between chambers 404 and 424 and allowing the relaxed skin tissue to stretch asymmetrically in a direction indicated by arrow 454 and further effect directional displacement of applicator 100 in a direction opposite to that indicated by arrow 454, here indicated by arrow 492.

Figure 4F:
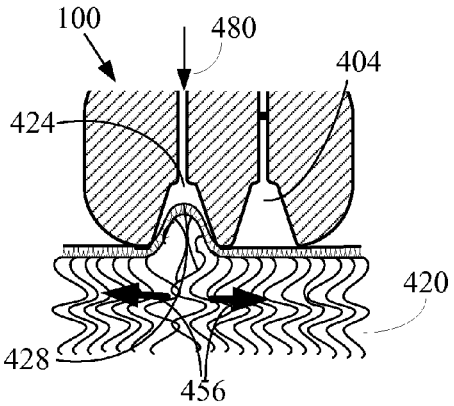

In FIG. 4F, chamber 424 is vented, increasing the pressure inside the chamber to surrounding ambient air pressure and releasing the suction holding protrusion 428 inside chamber 424 in place. Alternatively, positive air pressure is pumped into chamber 424, as indicated by arrow 480, urging skin tissue protrusion 428 out of vacuum chamber 404 and effecting symmetrical movement of skin tissue 416 in a direction indicated by arrows 456. At this stage there is no displacement of applicator 100.

It is appreciated that this cycle may be repeated or reversed, with or without concurrent energy treatment application, in accordance with a predetermined treatment program protocol to effect back and forth massaging skin tissue 416 in parallel to the surface thereof, further breaking down the collagen fibrous septae in the sub-dermis 420, which are perpendicular in orientation to the direction of movement of skin tissue 416. Additionally and alternatively, this cycle may be repeated or reversed, with or without concurrent energy treatment application, in accordance with a predetermined treatment program protocol to alternate the application of suction inside adjacent chambers asymmetrically, effecting movement of applicator 100 along the surface of skin tissue 416.

Figure 5:
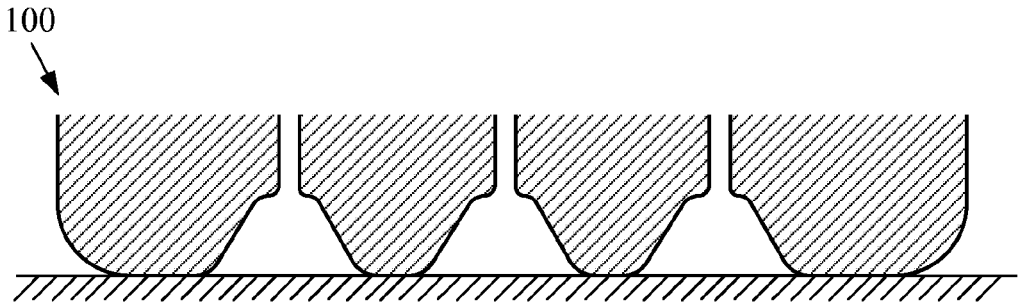
FIG. 5 is a simplified illustration of the apparatus of FIG. 1 arranged in a three-chamber arrangement.

Reference is now made to FIG. 5, which is a simplified illustration of applicator 100 of FIG. 1 arranged in a three-vacuum chamber arrangement. It will be appreciated that applicator 100 may arranged in plurality of multiple-chamber arrangements including two or more chambers arranged in a row, a grid-like arrangement or arranged in any other suitable geometrical pattern.

Figure 6:
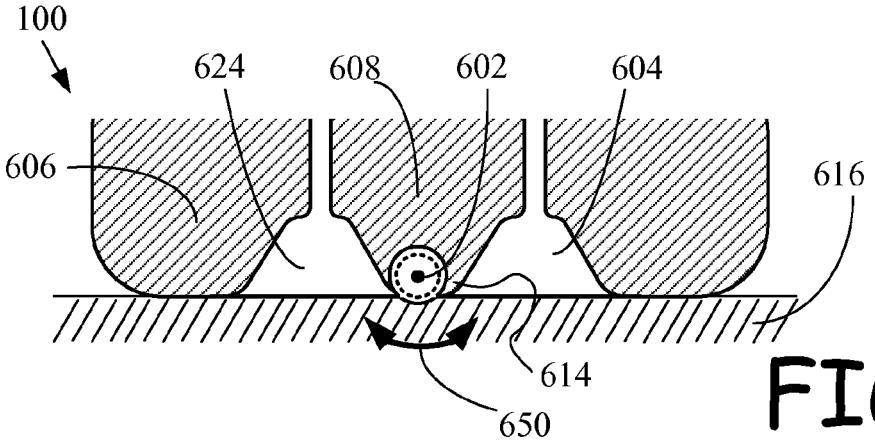
FIG. 6 is a simplified illustration of the apparatus of FIG. 1 further including a roller in accordance with still another exemplary embodiment of the method and apparatus.

Reference is now made to FIG. 6, which is a simplified illustration of applicator 100 of FIG. 1 in accordance with an exemplary embodiment further including a roller 602 at the sealing edge 614 of common wall 608 between two adjacent vacuum chambers 604 and 624 in accordance with an exemplary embodiment of the method and apparatus. Roller 602 reduces friction at the sealing edge 614 of wall 608 and facilitates back and forth displacement of applicator 100 over the surface of skin tissue 616 as indicated by arrow 650. It will be appreciated that roller 602 may be placed at the sealing edge of any wall, such as 606 and be replaced with any element that facilitates the massaging of skin tissue 616 and displacement of applicator 100 such as a ball, a cylinder, sliders, etc. Additionally and alternatively, roller 602 may be shaped to enhance massaging of skin tissue 616 being urged thereagainst.

Figure 7:
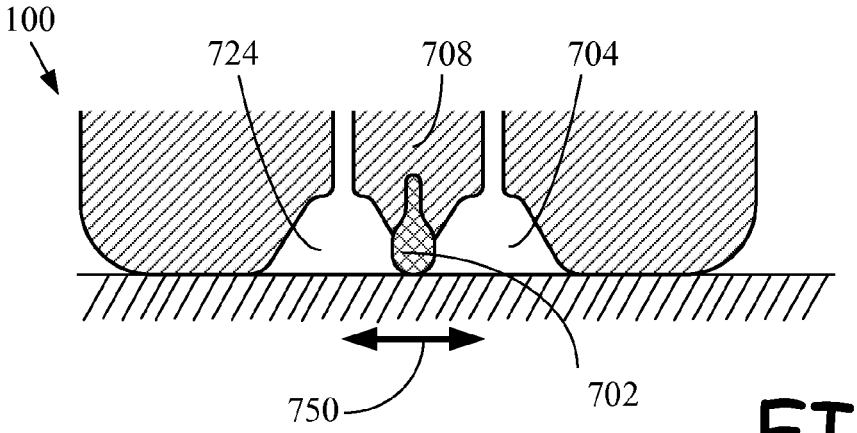
FIG. 7 is a simplified illustration of the apparatus of FIG. 1 further including a flexible divider between adjacent vacuum chambers in accordance with further exemplary embodiment of the method and apparatus.

Reference is now made to FIG. 7, which is a simplified illustration of applicator 100 of FIG. 1 in accordance with an exemplary embodiment further including a flexible divider 702 flexibly attached to, or partially embedded in, common wall 708 between adjacent vacuum chambers 704 and 724. Flexible divider 702 may be made of any suitable flexible material, which would allow pivotal back and forth movement of divider 702 as indicated by arrow 750. Alternatively, flexible divider 702 may made of either a flexible or rigid suitable material and pivotally attached to the sealing edge of wall 708.

It will be appreciated that exemplary embodiments of the method and apparatus may be also employed in other aesthetic skin tissue treatments such as sub-dermal fat cells breakdown lessening the amount of sub-dermal fat, tightening loose skin, tightening and firming body surface, reducing wrinkles in the skin and collagen remodeling.

It will also be appreciated by persons skilled in the art that the present method and apparatus is not limited to what has been particularly shown and described hereinabove. Rather, the scope of the method and apparatus includes both combinations and sub-combinations of various features described hereinabove as well as modifications and variations thereof which would occur to a person skilled in the art upon reading the foregoing description and which are not in the prior art.

What is claimed is:

1. A method for treating skin comprising:

applying to a skin surface an applicator, the applicator comprising: a housing comprising a first vacuum chamber and a second vacuum chamber, the first vacuum chamber comprising a first wall and a first sealing edge that defines a first cavity; the second vacuum chamber comprising a second wall and a second sealing edge that defines a second cavity and; wherein a portion of the first sealing edge and a portion of the second sealing edge form a common sealing edge region between the first and second cavities; and wherein the first and second sealing edges are coated with a high-friction coating;

abutting the first and second sealing edges to the skin surface;

applying sub-atmospheric pressure to the first vacuum chamber to draw a first skin region into the first cavity; and then concurrently a) venting the first vacuum chamber to the atmosphere and b) applying subatmospheric pressure to the second vacuum chamber to draw a second skin region into the second cavity.

2. The method according to claim 1 wherein venting further comprises placing the first vacuum chamber under positive pressure.

3. The method according to claim 1 further comprising, after concurrently a) venting the first vacuum chamber and b) applying subatmospheric pressure to the second vacuum chamber, concurrently c) applying subatmospheric pressure to the first vacuum chamber and d) venting the second vacuum chamber.

4. The method according to claim 3 wherein venting the second chamber further comprises placing the second vacuum chamber under positive pressure.

5. The method according to claim 3 further comprising applying energy to the first and/or the second skin regions.

6. The method according to claim 3 wherein the first skin region is treated with energy while inside the first cavity.

7. The method according to claim 3 wherein the second skin region is treated with energy while inside the second cavity.

8. The method according to claim 5 wherein the energy is selected from the group consisting of light, radiofrequency radiation, ultrasound, electrolipophoresis, iontophoresis and microwave radiation.

* * * * *